United States Patent [19]

Ingle

[11] Patent Number: 4,727,667

[45] Date of Patent: Mar. 1, 1988

[54] EXTENDED WRAP AROUND LABELS

[75] Inventor: Donald E. Ingle, Upland, Calif.

[73] Assignee: Best Label Co., Cerritos, Calif.

[21] Appl. No.: 931,407

[22] Filed: Nov. 14, 1986

[51] Int. Cl.[4] ..... G09F 3/00

[52] U.S. Cl. ..... 40/306; 40/21 B

[58] Field of Search ..... 40/306, 310, 594, 21 B, 40/2 R; 156/152, 289

[56] References Cited

U.S. PATENT DOCUMENTS

| | | | |
|---|---|---|---|
| 1,756,944 | 5/1930 | Gorton, Jr. | 40/306 |
| 1,949,903 | 3/1934 | Tales | 40/310 |
| 2,015,268 | 9/1935 | Hammond | 156/289 |
| 2,706,865 | 4/1955 | Miller | 40/306 |
| 3,720,130 | 3/1973 | Holson | 40/158 R |
| 4,128,954 | 12/1978 | White | 40/306 |
| 4,312,523 | 1/1982 | Haines | 40/306 |
| 4,318,235 | 3/1982 | Augeri | 40/306 |
| 4,323,608 | 4/1982 | Denny et al. | 40/2 R |
| 4,324,058 | 4/1982 | Sherwick et al. | 40/2 R |
| 4,324,823 | 4/1982 | Ray, III | 40/2 R |

*Primary Examiner*—Robert Peshock
*Assistant Examiner*—Cary E. Stone
*Attorney, Agent, or Firm*—Edward D. O'Brian

[57] ABSTRACT

When a comparatively large amount of material must be located on the label for a comparatively small container such as a bottle it is desirable to form the label so that a first portion of it can be wrapped around and adhesively secured to the exterior of the container and so that a second portion can be wrapped around and adhered to the exposed surface of the first portion. The adhesive used in adhering the second portion to the first has less adhesion than that used to hold the first portion to the container. This is preferably achieved by overprinting an adhesive coating on the second portion with a non-adhesive material.

9 Claims, 5 Drawing Figures

EXTENDED WRAP AROUND LABELS

BACKGROUND OF THE INVENTION

The invention set forth in this specification is specifically directed towards new and improved extended, wrap around labels. It is also concerned with a process of making surfaces used in such labels and other articles so that such surfaces possess only a limited adhesion and with various articles having surfaces which possess only a limited adhesion even though they have been coated with an adhesive having a significant degree of adhesion.

Unfortunately the amount of information which can be located on a conventional label of a type which is entirely adhered to the surface of a container such as a bottle is limited by the surface area of the largest label it is possible to locate on such a container. In the past this has led to at least one proposal to form a label to be applied to a cylindrical container so that a first portion of the label is adapted to be wrapped around and adhered to the exterior of the container and so that the remainder or second portion of the label is wrapped around the first portion of the label and is secured in place by the end of this second portion being fastened in place by an adhesive.

With this type of structure the end can be torn from the adjacent part of the second portion so that the second portion can be pulled back from or unwound from the container. Also with a label of this type printing on the exposed surface or front of the first portion of the label and on both the front and the back of the second portion can then be inspected. As a consequence of this the entire label can contain a great deal more information than if it only extended around the container.

While a label structure as indicated in the preceding discussion is unquestionably utilitarian such a structure can also be considered as relatively undesirable. This is because after the second portion of the label has been peeled back so that it can be inspected it can not be easily reattached in its original position. As a consequence the second portion of a label of the type noted becomes something of a loose "tail" after its end has been severed. If this should occur normally the information on the severed portion will become lost. Since such information is often important as, for example, in the case of a pharmaceutical preparation there is an element of possible danger whenever the noted type of label is used.

BRIEF SUMMARY OF THE INVENTION

Because of this it is considered that there is a need for new and improved extended wrap around labels which are closely related to labels as indicated in the preceding discussion. The present invention is intended to fulfill this and other needs.

More specifically this invention is intended to provide new and improved labels which may be easily and conveniently manufactured at a comparatively nominal cost using known equipment, which may be easily installed on containers such as bottles, which may be used to contain or carry a comparatively large amount of information and which may be easily manipulated so that extending ends or portions of these labels containing information may be easily secured in place against damage after they have been moved outwardly from a container and inspected.

The invention is also intended to provide a new and improved method of creating an adhesive surface having a desired degree of adhesion which is less than the adhesion provided by an adhesive which extends across a surface so that an entire layer or film of the adhesive is exposed. A related objective of the invention is to provide adhesive surfaces on articles which have a "controlled" degree of adhesion which is less than that obtained from continuous layers or fils of an adhesive on such surfaces.

The principal of these objectives are achieved by providing an elongated strip-like label having a front, a back, and ends, a first portion of said label adjacent to and extending from one of said ends being adapted to be wrapped around a cylindrical exterior of a container with its back surface in contact with and adhesively secured to said exterior of said container and a second portion of said label adjacent to and extending from the other of said ends being adapted to be wrapped around at least part of said exterior of said container with the back of said second portion facing in the direction of the front of said first portion when said first portion is located as indicated in which the improvement comprises:

at least the back of said second portion adjacent to said other of said ends being coated with an exposed amount of a pressure sensitive adhesive which is sufficiently adherent to secure said second portion to the part of front of said label under said pressure adhesive when all of said label is wrapped around said exterior of said container, said pressure sensitive adhesive having such a limited adherence for said front of said label that said second portion of said label can be peeled away from said part of the front of said label under said pressure sensitive adhesive so that both sides of said second portion can be inspected and so that the front of said first portion can be inspected, said pressure sensitive adhesive being of such adherence that said second portion can be readhered to the front of said label in the position in which it was formerly located after it has been peeled away from the front of said label.

In accordance with this invention the surface of the label carrying such a pressure sensitive adhesive is preferably first completely coated with a continuous coating on a pressure sensitive adhesive and then a pattern of a non-adhesive material such as a clear lacquer type ink is printed over the layer of the adhesive so that only a limited amount of the adhesive is exposed.

BRIEF DESCRIPTION OF THE DRAWING

Because of the nature of this invention it is best more fully explained by referring to the accompanying drawing in which.

Figure 1:
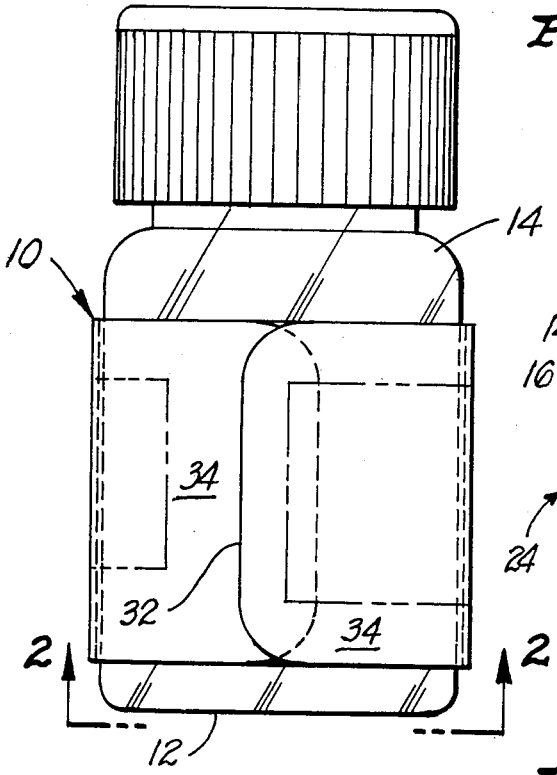
FIG. 1 is a side elevational view of a cylindrical bottle provided with a presently preferred embodiment of a label in accordance with this invention.
Figure 2:
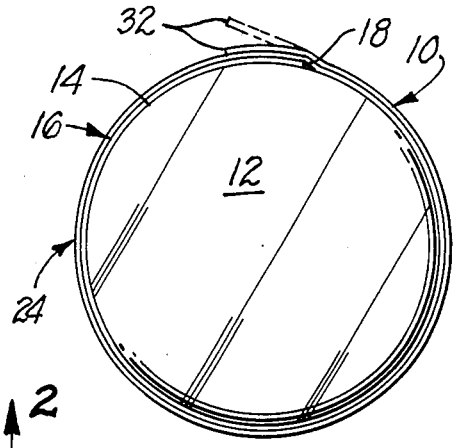
FIG. 2 is a bottom plan view of the bottle shown in FIG. 1 taken in the direction of the line 2—2 in FIG. 1.

It is to be realized that the accompanying drawing is primarily intended to be used for explanatory purposes and is not intended to illustrate an actual label drawn to a precise scale. The label shown in the drawing is constructed so as to utilize the principles or concepts of the invention defined in the appended claims. Those skilled in the field of making pressure sensitive labels will easily realize that these concepts or principals can be easily applied in a wide variety of different labels through the use of exercise of routine skill in the field of designing and using pressure sensitive labels. For these reasons the invention is to be considered as being limited solely by the appended claims.

DETAILED DESCRIPTION OF THE PREFERRED EMBODIMENT

In FIG. 1 of the drawing there is shown a strip-like label 10 in accordance with the present invention installed upon a common bottle 12 having a conventional cylindrical exterior 14. A first portion 16 of the label 10 extends from an end 18 of this label 10, approximately half-way along the length of the label 10. This portion 16 is preferably sufficiently long so as to extend approximately 360 degrees around the bottle 12. It is adapted to be secured in place on the exterior 14 through the use of a continuous film or coating 20 of a known pressure sensitive adhesive on the back 22 of the label 10.

This film or coating 20 extends the entire length of the back 22 of the label 10 along a second portion 24 of this label 10. As will be apparent in the embodiment of the label 10 shown this second portion 24 also extends along about half of the length of the label 10. The adherence of the film or coating 20 along the length of this second portion 24 has been decreased with the structure shown by overprinting or overcoating the film or coating 20 with a pattern 26 of circles 28 of a non-adhesive composition—normally a conventional type of clear lacquer or ink—so as to decrease the amount of the film or coating 20 which is exposed along the length of the second portion 24. If desired a small continuous area 30 of such a non-adhesive composition can be provided along an end 32 of the label remote from the end 18 so as to facilitate the manipulation of the second portion 24 when the entire label 10 has been installed as shown.

The installation of the label 10 is considered rather obvious from the drawing. First the portion 16 is wrapped around the exterior 14 as moderate pressure is applied to it so as to cause the layer 20 to adhere to the bottle 12. This wrapping action is continued until the second portion 24 is wrapped around that part of the front 34 of the label 10 which extends along the first portion 16 and is adhered to it by the comparatively limited amount of the layer or coating 20 exposed through the pattern 26. When the wrapping is finished that part of the front 34 which extends along the second portion 24 is exposed.

At this point the label 10 can be manipulated by engaging the end 32 so as to pull the second portion 24 generally away from the bottle 12 so as to unwrap it from the exterior 14 until such time as the entire second portion 24 extends outwardly from the bottle 12. It is normally comparatively easy to manipulate the label 10 to this extended position since the second portion 24 is only weakly attached to the first portion 16 due to the limited amount of the layer or coating 20 exposed along this second portion 24. Normally it will be quite difficult to peel the first portion 16 off of the bottle 12 due to the comparatively large amount of adhesion exhibited by the continuous layer or coating along the first portion 16.

Figure 3:
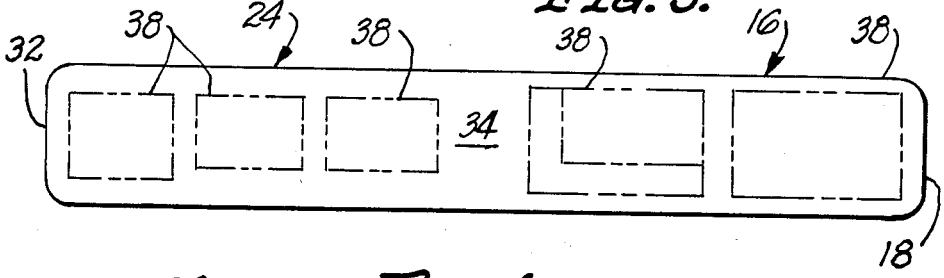
FIG. 3 is front elevational view at a reduced scale of the label shown in FIG. 1.
Figure 4:
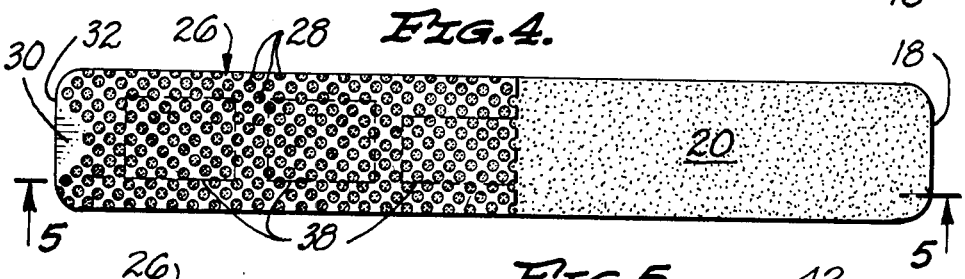
FIG. 4 is a rear elevational view of the label shown in FIG. 1 at the same scale as FIG. 3.

When the label 10 has been manipulated as indicated various indicia 38 on the front 34 along the first portion 16 and on both the front 38 and back 22 along the second portion 24 can be readily inspected and, depending upon the nature of the indicia 38, read. The indicia 38 are shown as dotted blocks in FIGS. 3 and 4 for convenience of illustration. Again, for convenience of illustration they are shown as short lines designated by the same numeral 38 in FIG. 5 of the drawing.

Figure 5:
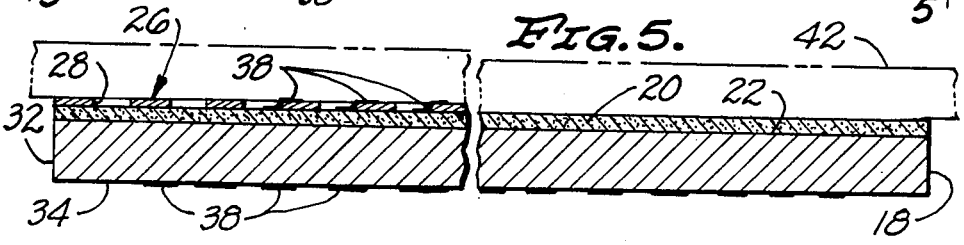
FIG. 5 is a diagrammatic cross sectional view corresponding to a cross sectional view taken at line 5—5 in FIG. 5 at an enlarged scale.

Because it is believed that it will be readily apparent how the labels 10 can be manufactured it is not considered necessary to further describe a manner of making them in this specification. Virtually any desired pattern 26 can be printed on an adhesive coating or film 20 in order to "control" the adhesion of such a layer or film using conventional, known techniques. A conventional release sheet 42 can be used as shown in FIG. 5 as an aid to the handling of a label 10.

I claim:

1. An elongated strip-like label having a front, a back and ends, a first portion of said label adjacent to and extending from one of said ends being adapted to be wrapped around a cylindrical exterior of a container with its back surface in contact with and adhesively secured to said exterior of said container and a second portion of said label adjacent to and extending from the other of said ends being adapted to be wrapped around at least part of said exterior of said container with the back of said second portion facing in the direction of the front of said first portion when said first portion is located as indicated in which the improvement comprises:

at least the back of said second portion adjacent to said other of said ends being coated with an exposed amount of a pressure sensitive adhesive which is sufficiently adherent to secure said second portion to the part of front of said label under said second portion when all of said label is wrapped around said exterior of said container, said pressure sensitive adhesive having such a limited adherence for said front of said label that said second portion of said label can be pealed away from said part of the front of said label under said pressure sensitive adhesive so that both sides of said second portion can be inspected and so that the front of said first portion can be inspected, said pressure sensitive adhesive being of such adherence that said second portion can be readhered to the front of said label in the position in which it was formerly located after it has been pealed away from the front of said label.

2. A label as claimed in claim 1 wherein:

the entire back of said second portion is coated with said amount of said pressure sensitive adhesive.

3. A label as claimed in claim 2 wherein:

said pressure sensitive adhesive is present as a continuous layer over the entire back of said second portion, said label including a pattern of non-adhesive material located over said layer of pressure sensitive adhesive so as to limit the amount of said pressure sensitive adhesive which is exposed.

4. A label as claimed in claim 1 wherein:

said front of said first portion and said back and said front of said second portion are provided with visibly apparent indicia.

5. A label as claimed in claim 1 wherein:

an area of said back of said second portion adjacent to said other of said ends being of a non-adhesive character so as to facilitate the manipulation of said other end when said label is in use on a container.

6. A label as claimed in claim 1 wherein:

the entire back of said second portion is coated with said amount of said pressure sensitive adhesive, said pressure sensitive adhesive is present as a continuous layer over the entire back of said second portion, said label including a pattern of non-adhesive material located over said layer of pressure sensitive adhesive so as to limit the amount of said pressure sensitive adhesive which is exposed, said front of said first portion and said back and said front of said second portion are provided with visibly apparent indicia.

7. A label as defined in claim 1 wherein:

said first portion of said label is sufficiently long so as to extend substantially 360 degrees around said exterior of said container, and said second portion extends along the length of said strip which does not form part of said first portion.

8. A label as claimed in claim 1 wherein:

the entire back of said second portion is coated with said amount of said pressure sensitive adhesive, said pressure sensitive adhesive is present as a continuous layer over the entire back of said second portion, said label including a pattern of non-adhesive material located over said layer of pressure sensitive adhesive so as to limit the amount of said pressure sensitive adhesive which is exposed, said front of said first portion and said back and said front of said second portion are provided with visibly apparent indicia, said first portion of said label is sufficiently long so as to extend substantially 360 degrees around said exterior of said container, and said second portion extends along the length of said strip which does not form part of said first portion.

9. A label as claimed in claim 8 wherein:

the entire back of said second portion is coated with said amount of said pressure sensitive adhesive, said pressure sensitive adhesive is present as a continuous layer over the entire back of said second portion, said label including a pattern of non-adhesive material located over said layer of pressure sensitive adhesive so as to limit the amount of said pressure sensitive adhesive which is exposed, said front of said first portion and said back and said front of said second portion are provided with visibly apparent indicia.

* * * * *